US008267378B1

(12) United States Patent
Rosman

(10) Patent No.: US 8,267,378 B1
(45) Date of Patent: Sep. 18, 2012

(54) TRIPLE CYLINDER WITH AUXILIARY GAS OVER OIL ACCUMULATOR

(76) Inventor: Allan Rosman, Calabasas, CA (US)

( * ) Notice: Subject to any disclaimer, the term of this patent is extended or adjusted under 35 U.S.C. 154(b) by 0 days.

(21) Appl. No.: 13/385,065

(22) Filed: Feb. 1, 2012

(51) Int. Cl.
*B66F 3/24* (2006.01)

(52) U.S. Cl. ..... 254/93 R; 254/89 H; 254/8 R; 254/134; 60/413

(58) Field of Classification Search ..... 254/93 R, 254/89 H, 93 L, 2 R, 8 R, 2 B, 134; 60/413, 60/469, 412, 547; 92/60; 212/146, 162
See application file for complete search history.

(56) References Cited

U.S. PATENT DOCUMENTS 3,912,227 A * 10/1975 Meeker et al. ..... 254/271
4,020,636 A * 5/1977 Harries ..... 60/547.1
4,631,918 A 12/1986 Rosman
4,665,696 A * 5/1987 Rosman ..... 60/414
4,715,180 A * 12/1987 Rosman ..... 60/372
4,761,953 A * 8/1988 Rosman ..... 60/414
4,801,126 A * 1/1989 Rosman ..... 254/93 R
4,848,085 A 7/1989 Rosman
5,706,657 A * 1/1998 Amborski et al. ..... 60/413
7,047,734 B2 * 5/2006 Tosen et al. ..... 60/413
7,121,089 B2 * 10/2006 Tosen et al. ..... 60/413
2005/0086934 A1 * 4/2005 Tosen et al. ..... 60/413
2005/0098326 A1 * 5/2005 Tosen et al. ..... 172/2

* cited by examiner

*Primary Examiner* — Lee D Wilson

(57) ABSTRACT

A hydraulic lift system for artificial lift pumping or industrial hoisting comprises a three chamber cylinder, a gas over oil accumulator, a large structural gas accumulator and a large flow pilot operated check valve. A matrix variable frequency drive, a standard variable frequency drive, an electrical squirrel cage motor or a natural gas engines are part of the main prime mover alternatives.

10 Claims, 6 Drawing Sheets

12
43
10
52
13

TRIPLE CYLINDER WITH AUXILIARY GAS OVER OIL ACCUMULATOR

FIELD AND BACKGROUND OF THE INVENTION

The invention relates to an improvement on U.S. Pat. No. 4,801,126 "Hydraulically operated lift mechanism". This patent includes a three chamber cylinder that allows for the use of one chamber as a gas accumulator acting as a phantom counterweight for vertical Industrial hoisting and artificial lift pumping applications.

This mentioned patented invention has been successfully applied for artificial lift on the oil and water pumping industries, among others. It has done so with 10% of the weight of the classic equivalent Beam pump, and less than 50% energy consumption per barrel of fluid extracted.

However, when applications of the mentioned patent use the triple cylinder with the plunger pointing up, which is the case for artificial lift, the gas chamber ends being situated at the lower part of mentioned cylinder. It is very difficult to stop a migration of gas to the up chamber, not having the possibility to bleed the gas from the hydraulic oil, creating a much lower life for the cylinder and several maintenance issues. This use is a 24/7 application, totaling 8760 hours a year, a major engineering challenge.

This application entails the conversion of the triple cylinder gas chamber to contain now oil instead of gas. That former gas chamber will now be connected to an independent accumulator (gas over oil), whereas now the gas is above the oil instead of below, avoiding in this manner any migration of gas to the oil. A small third pump is now able to replenish the oil lost or the system can bleed this new oil chamber that no longer contains gas.

This new arrangement creates other major improvements:

- When a loss of load occurs (wire rope broken, rod parted) the present solution closes a ball valve that connects the large accumulator to the triple cylinder. No matter how fast this ball valve closes, a volume of pressurized gas stays in the cylinder launching the plunger at a very high speed to the end stop. On the new arrangement, when the load is lost, a check valve closes the oil connection to the triple cylinder, with a minimum energy left, hence avoiding the launching of the plunger.
- In artificial lift, when a pump stops, normally the rod load will change as time passes. In the older design of the triple cylinder, when that occurs, the position of the plunger changes due to the gas still in the cylinder, this gas will force a changed position when the load changes. This new arrangement will maintain the same position of the rod, no matters what occurs with the load.
- When, during servicing the unit, it is necessary to descend the plunger, the present technology makes this task difficult due to the rebounding of the plunger containing gas. As the new design has no gas, the annoying rebounding disappears.
- All seals of the triple cylinder are now under oil, making a leak far less important and increasing the life of the cylinder many times over, and at the same time eliminating many maintenance problems.

In one of the preferred designs, one or more matrix variable frequency drive (MVFD) designed for real four quadrant applications is used, able to return power to the grid with very high efficiency. This feature is indispensable as a vertical pumping movement has always energy generating parts of a cycle which is, with today's technology, energy lost. This device new MVFD has the added advantage to eliminate the harmonics on the power lines, a major problem with a standard VFD for the power companies.

In another design version, the prime mover, instead of an electric motor uses an engine propelled by the casing gas of the well itself. This application is very well suited to this design as a triple cylinder has a very low kinetic energy content, compared with a typical Beam pump, and the engine does no longer have the heavy kinetic load of the old design.

In another design version, a fixed speed electrical motor is attached to an over center swash plate pump/motor. The pump controls now the direction of the flow, the accelerations and decelerations as well as the speed. This set up eliminates the nasty frequencies created by variable frequency drives, and is also able to motor as well as generate power back to the grid.

SUMMARY OF THE INVENTION

According to one aspect of the invention, there is provided, as an add-on to the three chamber cylinder and structure of the present solution, a gas over oil accumulator, the oil port connected to the former gas chamber via a very large pilot operated check valve. The gas side of said accumulator is now connected to the large gas containers of the structure itself.

In one version, the hydraulic power system consist in one or more fixed delivery hydraulic motor-pumps with reversal operation via one or more electrical motors controlled by a variable frequency drive (VFD). This VFD could be a standard one with resistors to dissipate the generating energy, or better a Matrix VFD (MVFD), which automatically discharges to the grid the excess energy generated by the pumping system. Efficiency is enhanced and maintenance is lowered.

In another hydraulic power system version, one or more "over the center hydraulic pumps" moved by a fixed speed unidirectional electric motor or motors, or a natural casing gas or diesel engine as a prime mover, whereas the flow reversal, speed, accelerations and decelerations are realized by the "over the center hydraulic pump or pumps".

The hydraulic system will incorporate a low pressure charge pump to maintain a minimum pressure on the system, cool, take air out and filter the oil. A small accumulator will be used to help maintain the pressure when an over the center pump is used; another option is a VFD for the charge motor and used to maintain a constant pressure with a variable flow.

The hydraulic system will incorporate a medium pressure very low flow pump to refill the accumulator oil if there is a loss to the upper and/or lower chambers of the triple cylinder in all the versions for the system.

An electric system, containing a PC or PLC as the automatic interface to control this machinery. A screen will be available to control, set parameters, get feedback and diagnose failures. Moreover wireless control will also be available.

| | Part Name |
|---|---|
| 10 | Gas accumulator |
| 12 | oil/gas accumulator |
| 13 | Structural base |
| 14 | Service ball valve |
| 16 | Piston separator/oil/gas |
| 18 | Plunger of triple cylinder |
| 19 | (Matrix) Variable frequency drive |
| 20 | Variable speed reversible motor |
| 22 | Reversible hydraulic pump fixed delivery |
| 24 | Leakage flow meter with switch |
| 26 | Pressurized reservoir |
| 28 | Safety relief valve down flow |
| 30 | Safety relief valve up flow |
| 32 | Compensation valve |
| 34 | Check valve down flow |
| 36 | Check valve up flow |
| 38 | Compensation accumulator |
| 40 | Oil down chamber |
| 41 | Pressure gage |
| 42 | Oil up chamber |
| 43 | Triple cylinder |
| 44 | Oil counterweight chamber |
| 46 | Replenishing check valve |
| 47 | Accumulator relief valve |
| 48 | Relief valve charge system |
| 49 | Check valve |
| 50 | Air oil cooler |
| 52 | Large flow piloted safety Check valve |
| 53 | Ball valve accumulator discharge |
| 54 | Opening valve three way, two position |
| 56 | Pilot operated with manual control unidirectional flow control |
| 58 | solenoid valve three way, two position |
| 60 | Check valve |
| 62 | Low pressure filter |
| 63 | Medium pressure filter |
| 64 | Pressure drop switch |
| 66 | Make up low pressure charge pump |
| 68 | Prime mover of 66 and 70 pumps |
| 70 | Refill accumulator pump |
| 72 | Solenoid valve two way, two position, N.O. |
| 74 | Solenoid valve two way, two position, N.C. |
| 76 | Linear transducer, accumulator |
| 78 | Linear transducer, three chamber cylinder |
| 80 | Variable frequency drive |
| 82 | Oil/gas accumulator bottom |
| 84 | Bottom of triple cylinder |
| 86 | Bias spring |
| 88 | Pilot opening piston |
| 90 | Check valve body |
| 92 | Over center swash plate pump |
| 94 | Natural Gas Engine/or electric motor |
| 96 | |
| PT1 | Pressure transducer cylinder down chamber |
| PT2 | Pressure transducer cylinder up chamber |
| PT3 | Pressure transducer cylinder acc. chamber |
| PT4 | Pressure transducer accumulator chamber |

DETAILED DESCRIPTION OF THE INVENTION

Figure 1:
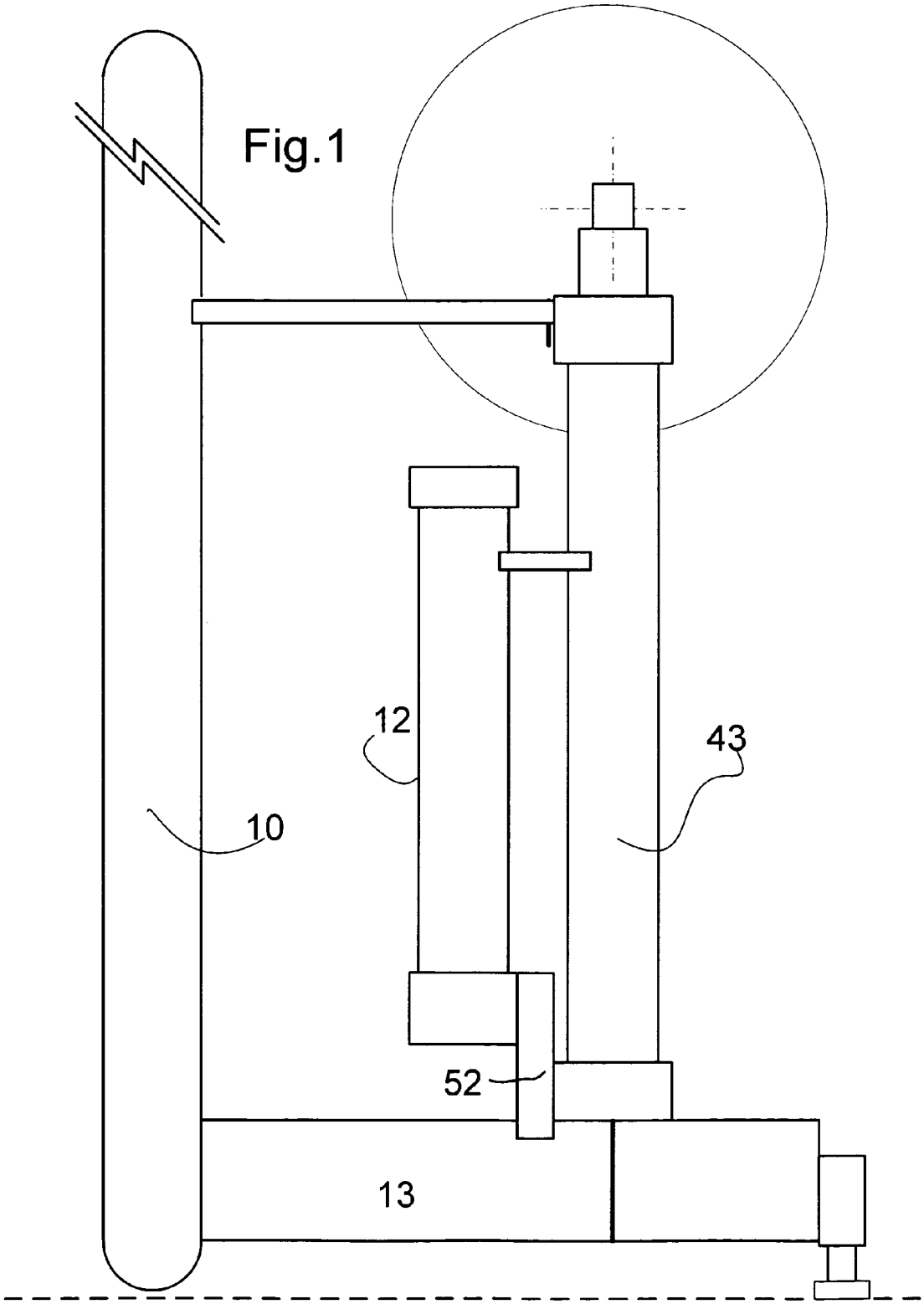
FIG. 1 is a large side view of the extra oil/gas accumulator positioning.

FIG. 1 represents one arrangement-of many-for the add-on oil over gas accumulator reference 12, with the large pilot operated check valve No 52. Pos 10 is the structural gas accumulator, pos 43 is the triple cylinder and pos 13 is the mechanical base structure.

Figure 2:
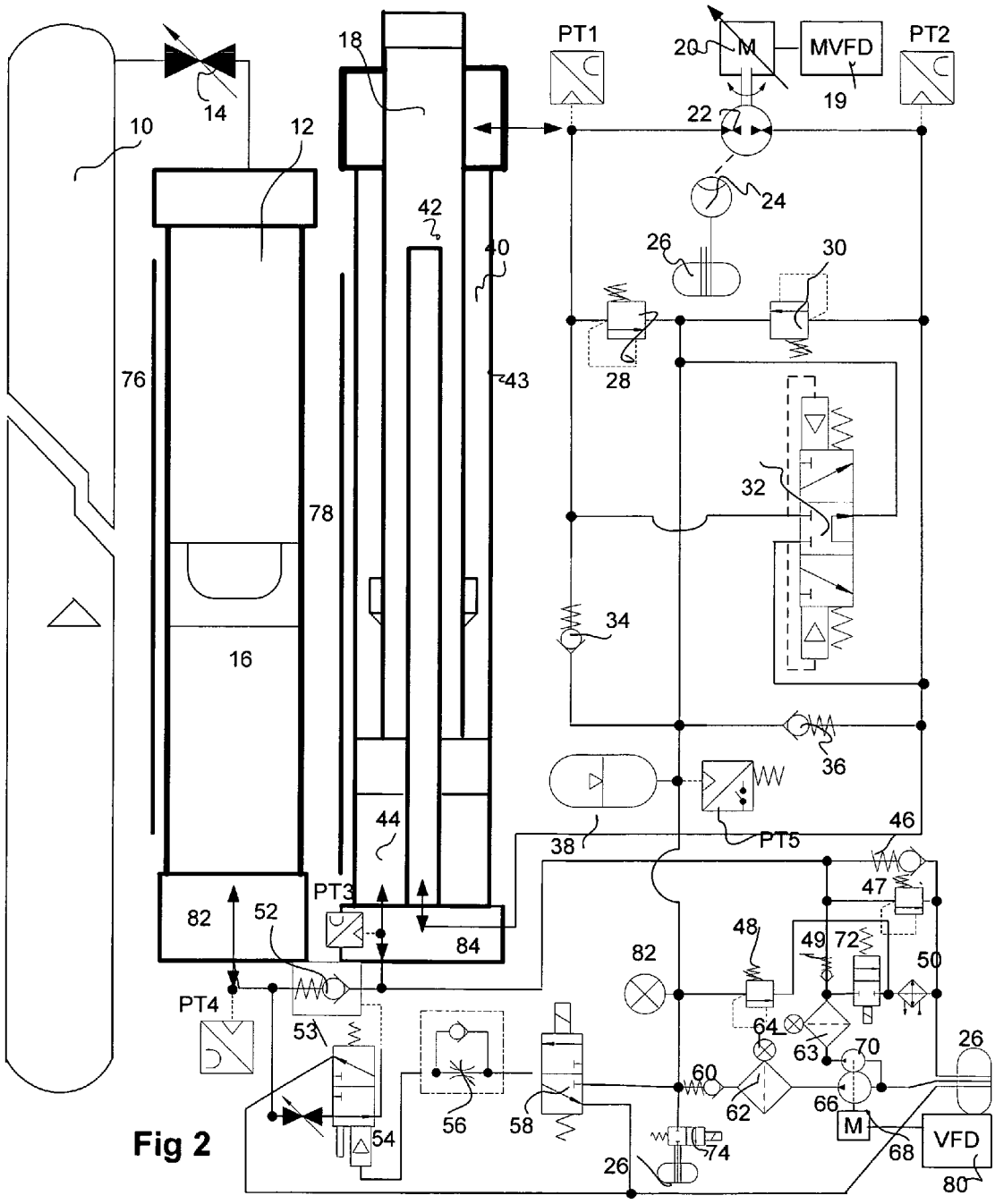
FIG. 2 is a schematic illustration of hydraulic schematics in accordance with one aspect of the invention.

One preferred embodiment of the present invention is illustrated on FIG. 2 of the drawings. It should be appreciated that the embodiment shown in FIG. 2 of the drawing is representative of a hydraulic schematics and variations and modifications may be made in accordance with the application.

With reference to FIG. 2 of the drawings, there is shown a preferred embodiment of one hydraulic circuit which falls within the scope of the Invention. FIG. 2 of the drawings shows schematically a triple cylinder 43, a gas over oil accumulator pos 12, and a pressured gas accumulator 10, connected to the gas side of the "gas over oil accumulator" pos 12. The pilot operated check valve pos 52, connects the oil side of the gas over oil accumulator with the third chamber of the triple cylinder, pos 44.

On the same reference FIG. 2, the operation of the unit is as follows: Matrix variable frequency drive (or MVFD) pos 19, controls speed, acceleration, deceleration and direction of electrical motor 20 which commands a reversible fixed flow hydraulic pump-motor pos 22. A matrix VFD allows for the use of a four quadrant real operating drive, generating power back to the grid in a very efficient way. In another version it is used a VFD with resistors to dissipate the generated energy. Pump-motor 22 flow oil to chamber 40 of triple cylinder 43 when going down, and will flow through internal rod 42 to go up.

In order for the system to operate, the check valve 52 has to be piloted open by pilot operated three way two position valve 54, which receives a pressure signal from solenoid valve three way, two position 58. The pressure signal originates from charge pump 66, propelled by electrical motor 68. So, to be able to operate check valve 52, it is required for the charge system to be pressurized, and an electrical signal to be received by the solenoid valve 58.

Charge pump 66 sends pressure to solenoid valve 58 and keeps a steady pressure on the low pressure side of the cylinder. The steady pressure is either maintained by an accumulator 38 or by a VFD controlling motor 68 speed with feed back by pressure transducer PT5. The charge pump flow goes trough filter 62-with pressure drop indicator 64-via check valve 60. Gage 82 indicates the visual charge pump pressure.

Charge pump 66 flow goes through relief valve 48 and cooler 60 ending back into reservoir 26. Replenish valve 46 allows the accumulator side of triple cylinder to avoid any vacuum. Safety relief valve 47 limits the accumulator pressure 44. Relief valves 28 and 30 limits the maximum pressure and valve 32 connects the low pressure side of the triple cylinder with the charge line.

Charge pump 66 goes through low pressure filter 62 and pressure drop indicator 64 and check valve 60.

Replenish pump 70 allows the refill of the oil of the accumulator oil side, in case some oil is lost to the other chambers of the triple cylinder. Pump 70 flows through medium pressure filter 63 all the time. This pump flow is normally going back to tank through cooler 50 under null pressure via solenoid valve 72. To operate this function, solenoid valve 72 is activated-closed, and solenoid valve 74 is also activated to open, leaving the charge pump flow 66 to go to tank. The ratio of flow among pump 66 and 70 will be around 10 to 1. This operation could be done manually or automatically. Relief valve 47 adjustment allows the reduction of the oil volume in the accumulator if a leak occurs from the triple cylinder to the accumulator. There will be no nitrogen gas lost.

The system is completed by pressure transducers PT1 to PT4 and linear transducers 78-rod positioning, and 76, piston 16 position. Flow switch or pressure transducer 24 controls the status of the leakage of pump-motor 22 for service purposes.

Figure 3:
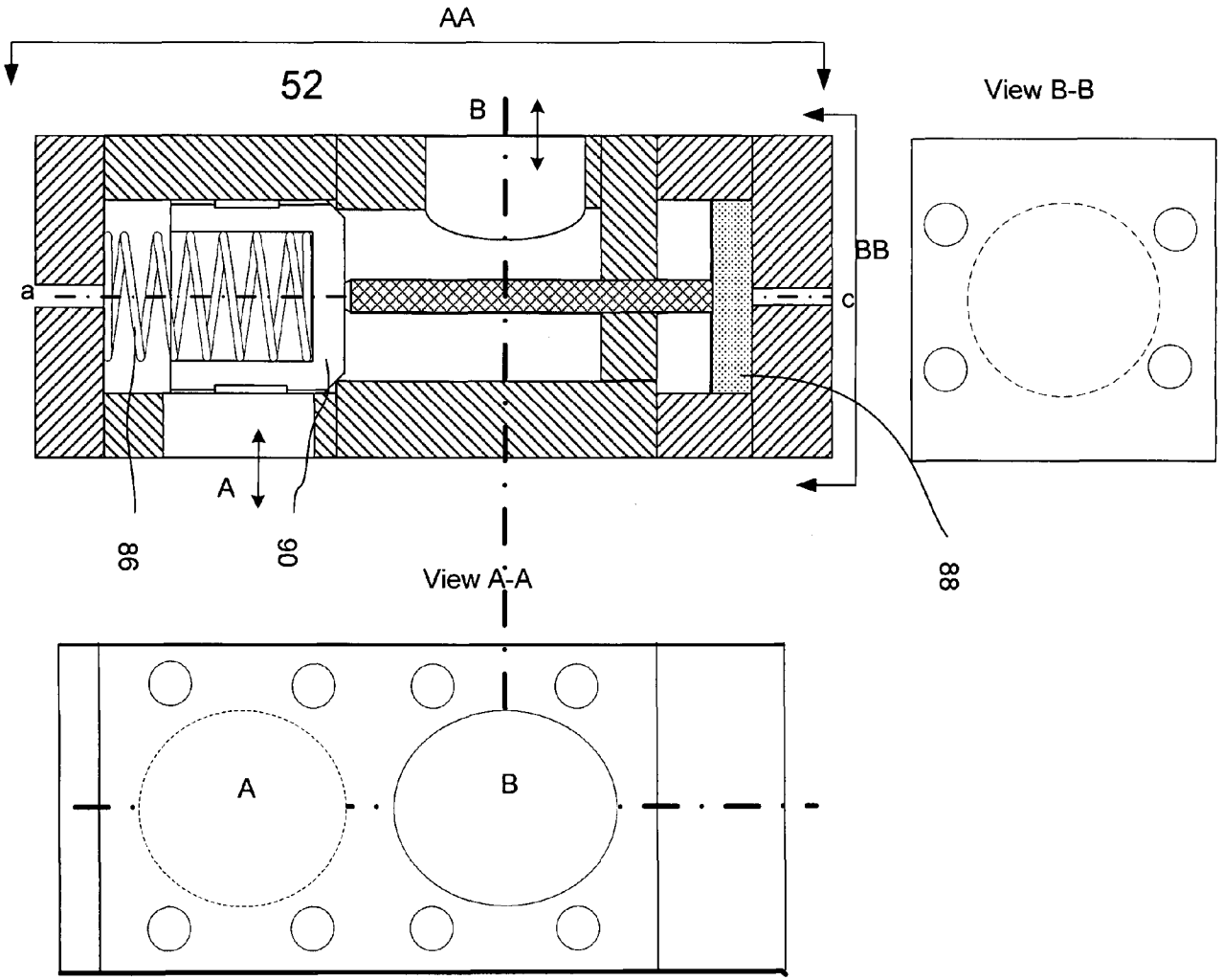
FIG. 3 is an illustration of a large flow pilot operated check valve.

FIG. 3 is a cutaway of pilot operated check valve 52, which has to handle very large flows, starting above 100 GPM. Port a has the accumulator pressure that is used to open the check valve via port C. Piston 88 diameter should be higher than 10% than check piston 90 diameter. Spring 86 guaranteed than, absent pressure pilot at port C, the check valve is closed by check valve body, stopping any transmission of flow and pressure to the triple cylinder.

Figure 4:
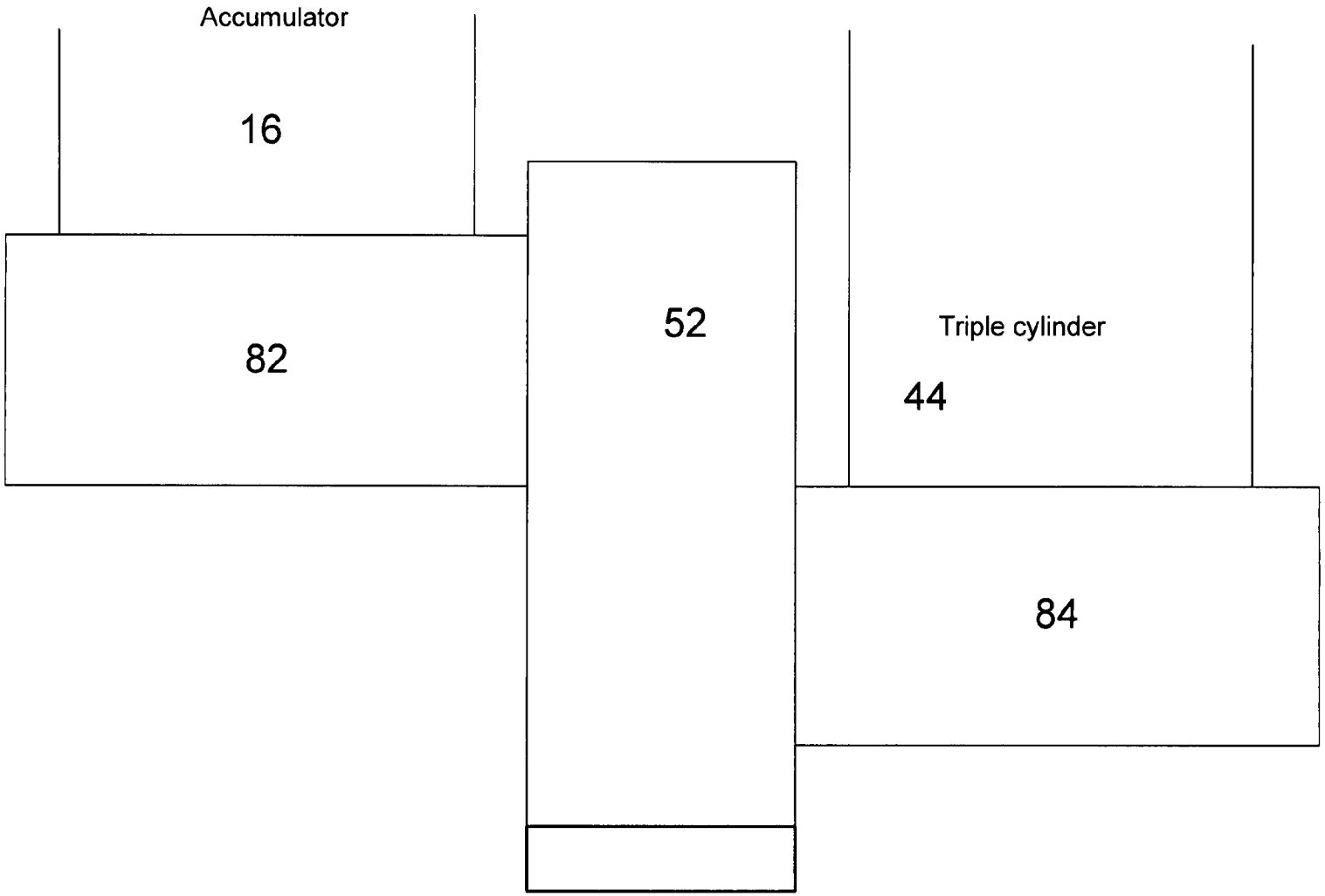
FIG. 4 is an illustration of the mechanical connection between the check valve and the bottom of the accumulator and the triple cylinder.

FIG. 4 is a side view one version of the bottom arrangement of the mechanical/hydraulic arrangement. Pos 2 is the bottom of the oil over gas accumulator, Pos 52 is the large flow pilot operated check valve and 84 is the bottom of the triple cylinder.

Figure 5:
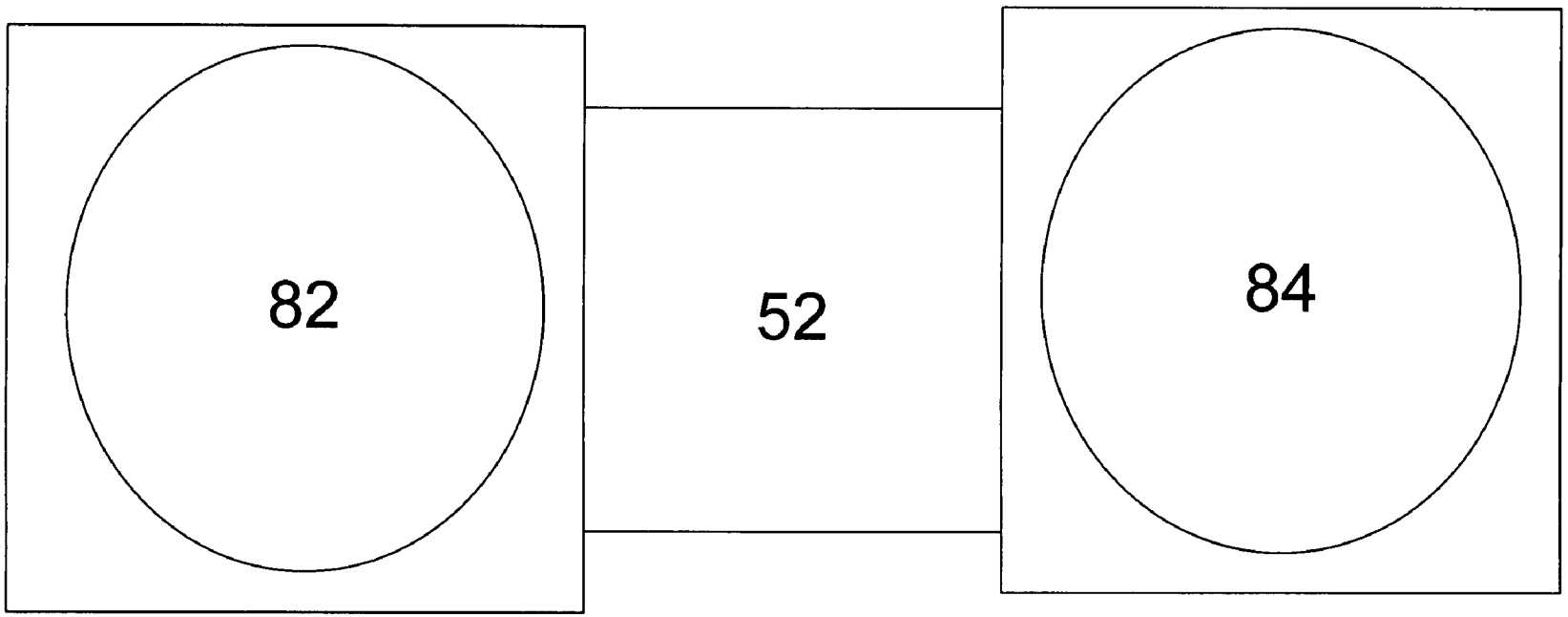
FIG. 5 is a top view of the mechanical connection of FIG. 3.

FIG. 5 is a top view of the bottom gas over oil accumulator 82, the large check valve 52 and the bottom of the three chamber cylinder 84.

Figure 6:
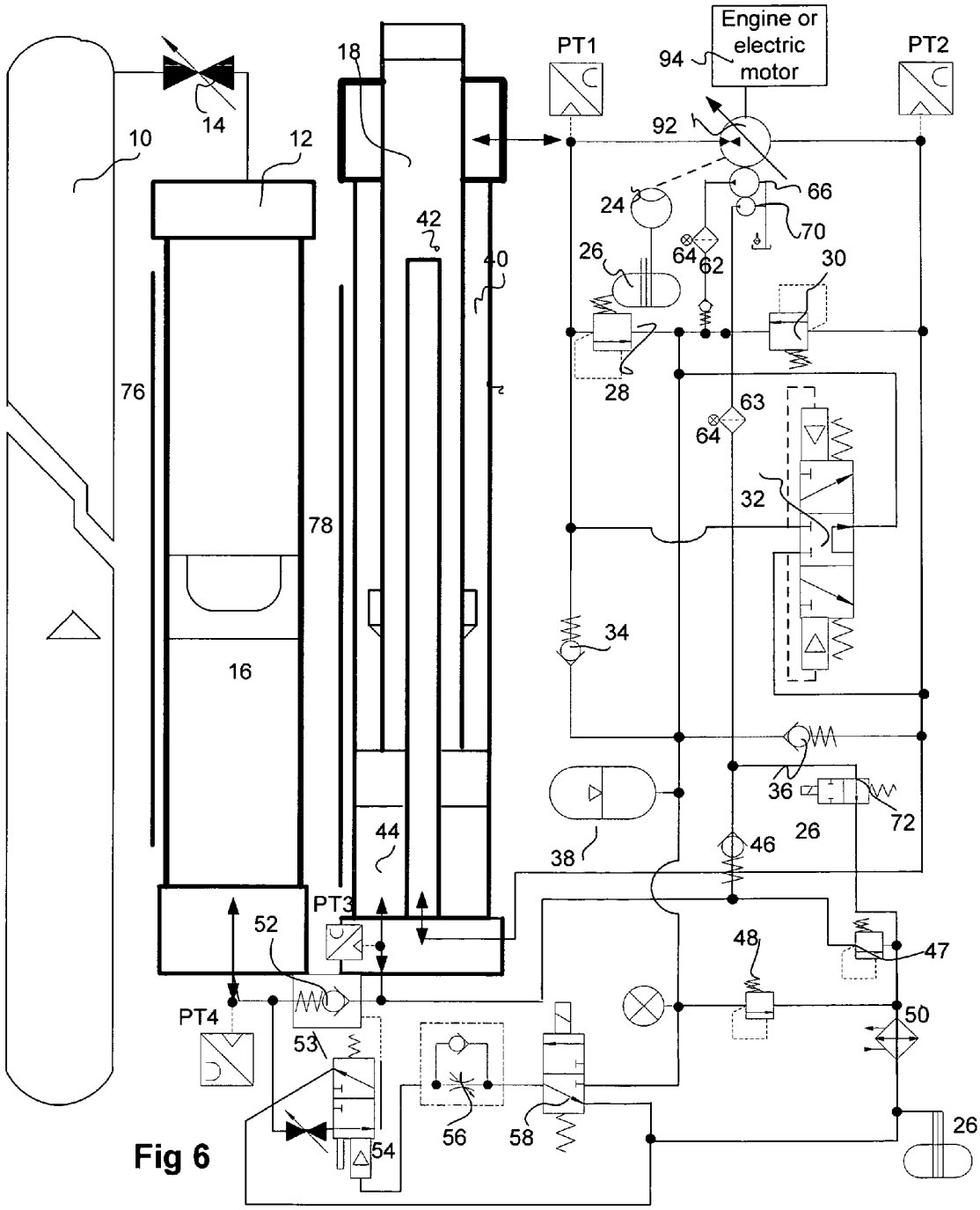
FIG. 6 is a schematic illustration of the hydraulic schematics using over the center hydraulic pumps.

FIG. 6 is very similar to FIG. 2 with the propelling differences as follows:

Oil flow comes now though a over center swash plate pump 92, motored by a constant speed natural gas or diesel engine 94, or a standard squirrel cage fixed speed electrical motor. Now the pump creates the speed, accelerations, decelerations and direction of the oil flow instead of a matrix VFD 19 in FIG. 2.

In FIGS. 2 and 6 a flow switch or transducer 24 allows for the direct feedback of the pump/motor leakage, facilitating troubleshooting and maintenance. Also a Pressure gage 41 is installed.

The invention claimed is:

1. An artificial hydraulic lift system for fluid pumping or Industrial hoisting comprising:

a triple cylinder comprising a housing have a top and bottom sections with the top section being an plunger opening and a bottom section with two oil connection lines, within said housing are a chamber with a diamenter, an annular piston dividing said chamber diameter, and said annular pistion connectod to a plunger with a second lesses diameter and which movably extends through said plunger opening, and an rod being an oil up chamber extending through said annular piston and said plunger;

a gas over oil accumulator comprising a housing having a top section with an gas line and a botom section with the oil line, and said housing being dividing into an oil section and gas section with a movable pistion inbetween and said gas over oil accumulator' oil line being connected to said oil connection line of said triple cylinder;

an auxiliary gas accumulator comprising a housing with a gas line which is connected to the gas over oil accummulor said gas lines connected to said top section; and a pilot operated check valve being connected inbetween said gas over oil accumulator and said triple cylinder.

2. The artificial hydraulic lift system as claimed in claim 1 further comprises a four quadrant matrix variable frequency drive for direction of flow a first and second direction accelerations, decelerations and speed.

3. The artificial hydraulic lift system as claimed in claim 1 further comprising an auxiliary pump to replenish oil losses on the gas over oil accumulator.

4. The artificial hydraulic lift system as claimed in claim 1 further comprising an auxiliary pump to maintain a minimum pressure in the system, plus cooling and filtering the hydraulic oil.

5. An artificial hydraulic lift system for fluid pumping or Industrial hoisting comprising:

a triple cylinder comprising a housing have a top and bottom sections with the top section being an plunger opening and a bottom section with two oil connection lines, within said housing are a chamber with a diamenter, an annular piston dividing said chamber diameter, and said annular pistion connectod to a plunger with a second lesses diameter and which movably extends through said plunger opening, and an rod being an oil up chamber extending through said annular piston and said plunger;

a gas over oil accumulator comprising a housing having a top section with an gas line and a botom section with the oil line, and said housing being dividing into an oil section and gas section with a movable pistion inbetween and said gas over oil accumulator' oil line being connected to said oil connection line of said triple cylinder;

an auxiliary gas accumulator comprising a housing with a gas line which is connected to the gas over oil accummulor said gas lines connected to said top section; and a pilot operated check valve being connected inbetween said gas over oil accumulator and said triple cylinder; and a unidirectional prime mover.

6. The artificial hydraulic lift system as claimed in claim 5, wherein the prime mover is a natural gas engine running at different constant speeds, depending of need.

7. The artificial hydraulic lift system as claimed in claim 5, wherein the prime mover is a squirrel cage electrical motor running at constant speed.

8. The artificial hydraulic lift system as claimed in claim 5, wherein the prime mover is connected to an overcenter swash plate hydraulic pump.

9. The artificial hydraulic lift system as claimed in claim 5 further comprising an auxiliary pump to maintain a minimum pressure in the system piggy backed to the over center swash plate pump.

10. The artificial hydraulic lift system as claimed in claim 5 further comprising an auxiliary pump to replenish the hydraulic oil for the gas over oil accumulator, piggy backed to the over center swash plate pump and the charge pump.

* * * * *